United States Patent [19]

Merrill, Jr. et al.

[11] Patent Number: 5,041,210

[45] Date of Patent: Aug. 20, 1991

[54] OIL SHALE RETORTING WITH STEAM AND PRODUCED GAS

[75] Inventors: LaVaun S. Merrill, Jr., Englewood; Larry D. Wheaton, Littleton, both of Colo.

[73] Assignee: Marathon Oil Company, Findlay, Ohio

[21] Appl. No.: 373,753

[22] Filed: Jun. 30, 1989

[51] Int. Cl.[5] ..... C10G 1/02

[52] U.S. Cl. ..... 208/407; 208/409; 208/424

[58] Field of Search ..... 208/407, 409, 424

[56] References Cited

U.S. PATENT DOCUMENTS

| | | | |
|---|---|---|---|
| 2,757,129 | 7/1950 | Reeves et al. | 208/407 X |
| 3,887,453 | 6/1975 | Veta et al. | 208/409 |
| 3,960,702 | 6/1976 | Allred | 208/11 R |
| 4,010,092 | 3/1977 | Deering | 208/11 R |
| 4,090,945 | 5/1978 | Reeves | 208/11 R |
| 4,116,810 | 9/1978 | Jones, Jr. et al. | 208/407 |
| 4,218,304 | 8/1980 | Styring, Jr. | 208/407 |
| 4,243,511 | 1/1981 | Alfred | 208/407 |
| 4,454,915 | 6/1984 | York et al. | 166/259 |
| 4,495,058 | 1/1985 | Farnham et al. | 208/11 R |

*Primary Examiner*—Asok Pal

*Attorney, Agent, or Firm*—Jack L. Hummel; Jack E. Ebel

[57] ABSTRACT

A process for retorting oil shale in a vertical retort. Recycle gas containing steam and produced gas is separated from the retort off-gas and used to heat the oil shale. The steam is present in amount by volume of the recycle gas of at least 40% and preferably 70%. The minimum particle size of the oil shale is such that the particles are retained on a screen having ¼ inch openings. The maximum particle size is such that the particles are capable of passing through a screen having 3 inch openings.

11 Claims, 2 Drawing Sheets

OIL SHALE RETORTING WITH STEAM AND PRODUCED GAS

FIELD OF THE INVENTION

This invention relates to a process for retorting oil shale. More particularly, it relates to a process for retorting oil shale in a vertical retort which uses heated gas to raise the temperature of the shale.

BACKGROUND OF THE INVENTION

Economically viable methods for extracting oil from oil shale have been under investigation for many years. Basically, all methods require the oil shale to be heated to a point at which kerogen, a hydrocarbonaceous component of oil shale, decomposes to yield shale oil. Generally, this phenomenon, known as pyrolysis, occurs at temperatures of about 850° F. to 900° F.

Although there are various types of retorts in which pyrolysis can be achieved, this invention is concerned with vertical retorts. In a vertical retorting operation, oil shale in particulate form is introduced through the top of a generally cylindrically shaped vertical retort in which the shale is heated to its pyrolysis temperature. At this temperature the kerogen releases shale oil vapors which are delivered to cooling and oil separating stations to produce both product oil and product gas.

The oil shale in a vertical retort process is heated by either steam or recycled product gas. The use of recycled product gas is convenient because the gas is available from the system and can readily be heated to the required temperature. For reasons not fully known, however, retorting with recycled product gas does not provide the same shale oil yields as when retorting with steam. In tests run to determine the difference in yield between the two systems, retorting yields using recycled product gas as the oil shale heating medium were about 10% less than retorting yields using steam as the heating medium.

The use of steam as the heating medium, even though it causes increased shale oil yields, raises other problems not associated with recycled product gas. The use of steam is more costly than the use of recycled product gas because of high compression costs to allow condensing of steam from the retort off-gas while boiling condensed steam, separated from oil and gases, for recycle. The use of pure steam also has the disadvantage of operating at high pressures, which add to the cost of the retort shell and complicate the lock-hopper design. Further, the site of an oil shale processing facility will generally be close to the area where the oil shale is found. Since such locations typically are found in arid areas the availability and cost of an adequate supply of water, even though recycled water may be used, can be a consideration. The decision as to which gaseous heating medium to use is thus frequently made on the basis of factors other than a determination of which system is capable of the highest yields of shale oil.

From the foregoing, it can be seen that it would be highly desirable to be able to use a heating medium in a vertical retorting operation which is readily available, economically satisfactory and at the same time capable of producing yields comparable to those produced by the use of steam.

SUMMARY OF THE INVENTION

In accordance with the invention, particles of oil shale are introduced into a vertical retort and are contacted by hot gas to heat the shale to a state of pyrolysis, thereby producing retort off-gas. The off-gas is removed from the retort and cooled, and shale oil is removed from the cooled off-gas. A portion of the off-gas is then separated into recycle gas which is comprised of steam and produced gas. The recycle gas is then heated and used to heat the oil shale.

The steam is present in the recycle gas in amounts by volume of at least 40% and the minimum size of the particles of oil shale is such that the particles are retained on a screen having openings of ¼ inch. Preferably, the process utilizes recycle gas comprising about 70% by volume of steam and particles of a maximum size such that the particles are capable of passing through a screen having openings of 3 inches in size. In order to maintain the steam content of the recycle gas at the desired level, water may be added as quench water to the bottom of the retort, preferably from the water obtained from the final separation of the cooled off-gas into product gas, product oil and water.

It has been found that the use of steam in amounts of only 40% by volume of the recycle gas results in a yield of shale oil which is about 98% of the yield obtained with steam alone as the heating gas. When steam is present in amounts of 70% or more by volume the yield is essentially the same as when using 100% steam.

Other features and aspects of the invention, as well as other benefits thereof, will readily be ascertained from the more detailed description of the invention which follows.

DESCRIPTION OF THE PREFERRED EMBODIMENT

Figure 1:
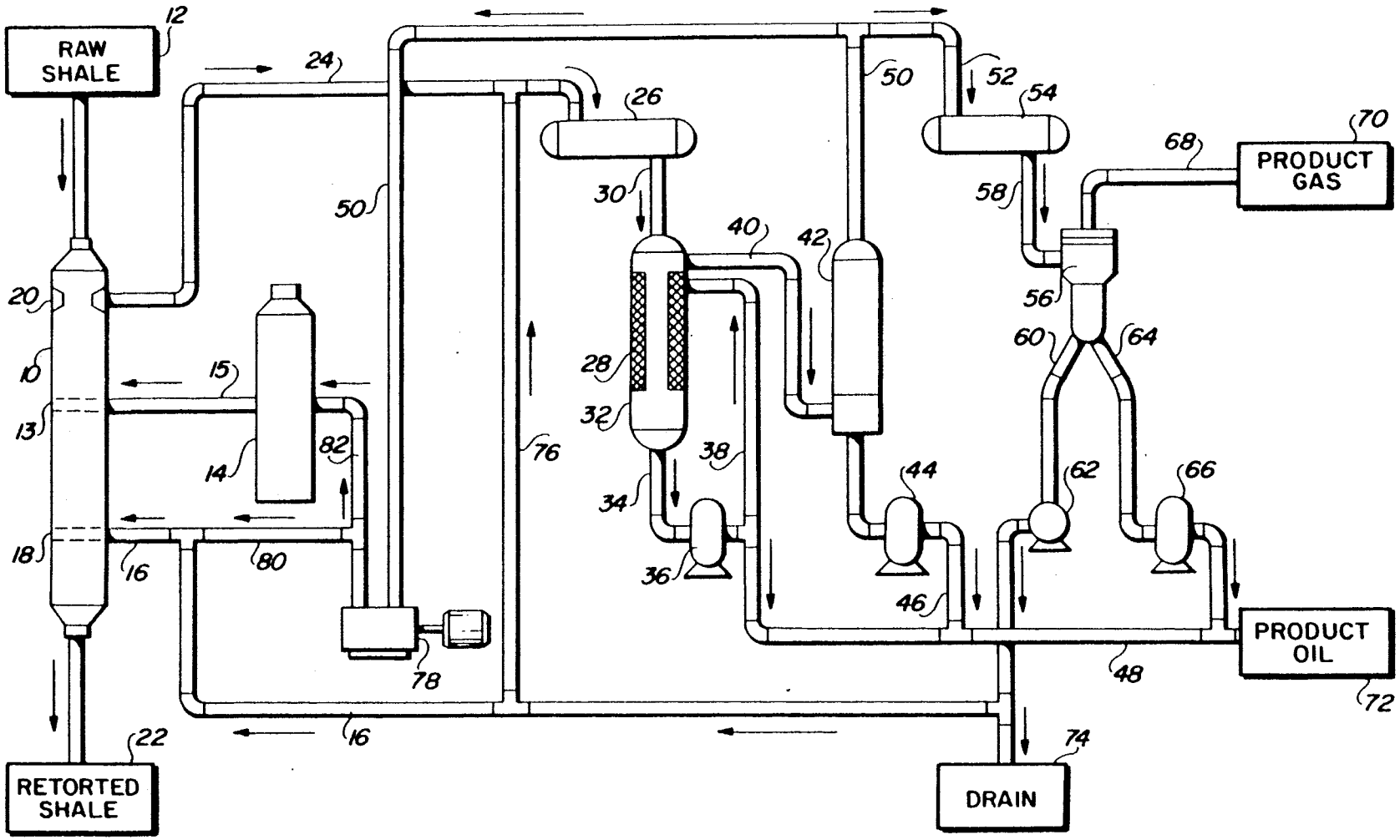
FIG. 1 is a flow diagram of an oil shale vertical retorting process incorporating the invention.

Referring to FIG. 1, the retorting process of the present invention incorporates a vertical retort 10 into which particles of raw shale 12 are introduced. Although not shown in detail, it will be understood that the shale may pass through a suitable lock chamber prior to being introduced into the top of the retort 10. The oil shale is contacted in the retort by heating gas introduced through gas distributor unit 13 through line 15 leading from the heater 14. Although the temperatures involved may vary, the temperature of the heating gas may typically be about 1100° F. in order to bring the temperature of the oil shale to the range of about 850° F. to 900° F. At this temperature pyrolysis or chemical decomposition of the kerogen component of the oil shale occurs. The hot retorted shale is cooled by a mixture of quench water from the water line 13 and recycle gas from line 80 introduced into the bottom portion of the retort through a suitable distributor 18. The gases which are present in the retort and which move upwardly in the retort as a result of the process are steam, consisting of recycle steam and vaporized quench water, water liberated from the oil shale, recycle pyrolysis gas and other gases resulting from pyrolysis of the oil shale, which include carbon oxides, hydrogen and light hydrocarbons. These gases, collectively known as the off-gas, exit the retort 10 through ports in a suitable discharge means 20.

The retorted shale 22 exits from the bottom of the retort 10 where it may be further treated, if desired, as by being crushed and taken away in an aqueous slurry.

After leaving the retort the off-gas travels through conduit 24 to a cooler 26 where it is cooled down to a range of about 250° F. to 300° F., after which it enters coalescer 28 through conduit 30. The coalescer may be of any suitable type, such as the one illustrated wherein the gas flows down through a central tube and back up through a surrounding packing 32. Oil obtained from the coalescing operation leaves the coalescer through line 34, a portion of the oil being circulated back into the packing by means of pump 36 and line 38 in order to keep the packing wet with oil. Control of the temperature of the cooled off-gas entering the coalescer 28 allows the coalescer to efficiently function.

Upon leaving the coalescer the remaining off-gas flows through a conduit 40 to an electrostatic precipitator 42 where oil is again removed. The oil is drawn off from the electrostatic precipitator by pump 44 in line 46 and joins the oil stream in the main oil discharge conduit 48 from the coalescing operation.

A portion of the gas leaving the electrostatic precipitator through line 50 passes through line 52 to a final cooler 54 where the temperature of the gas is lowered to a point conductive to the operation of the final separator 56 to which the gas flows through line 58. In the separator 56 water and oil are separated out, with the water passing through line 60 and pump 62, the oil through line 64 and pump 66 and the remaining gas through line 68. The remaining gas is the final product gas 70, while the oil from the final separator, along with the oil from the coalescing and electrostatic precipitator operations, comprises the product oil 72. A portion of the recovered water is sent to drain 74 and the remainder is circulated back into the system through conduit 16. Part of the water from conduit 16 is diverted through conduit 76 to the off-gas line 24 upstream from the cooler 26 in order to assist in the cooling and coalescing operations. The remainder is introduced into the retort through the distributor 18.

The gas from the electrostatic precipitator which does not flow into the final cooler 54 through line 52 is recycled through line 50 to the recycle gas compressor 78. A portion of the recycle gas line 80 is combined with quench water from line 16 and the mixture is fed to the bottom of the retort as a coolant. The compressed gas, which has been heated by the compressing operation to a temperature range in the order of about 325° F. to 375° F., raises the temperature of the cooling water to a desirable operating temperature. The remainder of the compressed gas is sent through conduit 82 to the recycle gas heater 14 where it is heated to a temperature, perhaps in the order of 1100° F., sufficient to heat the shale in the retort to the necessary pyrolysis temperature.

Figure 2:
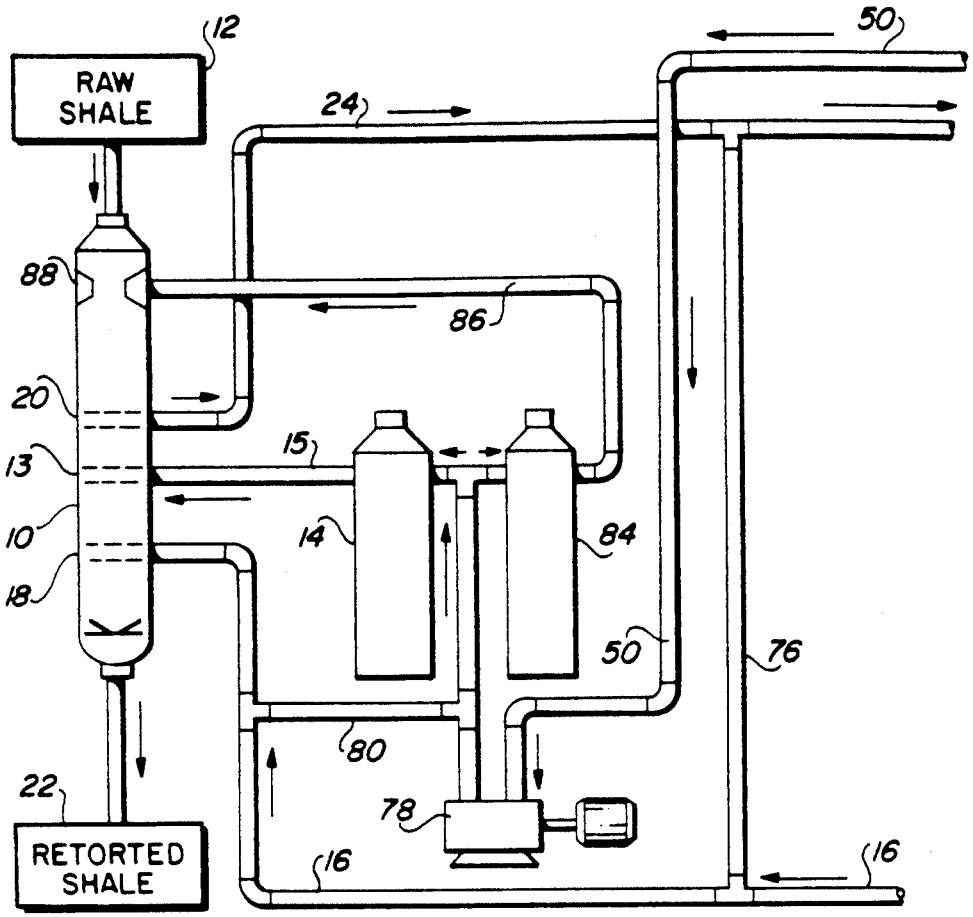
FIG. 2 is a partial flow diagram of an oil shale vertical retorting process showing a modification of the process of FIG. 1.

It is possible, depending upon the conditions in the retort, that contact between the oil vapors and the relatively cold oil shale in the top portion of the retort will cause an undesirable amount of condensing of the vapors onto the shale and consequent refluxing. In order to overcome this problem the process may be altered in accordance with the flow diagram of FIG. 2 wherein an additional heater 84 is utilized. Heated gas from the heater 14 would continue to be delivered to the retort through line 15 and distributor 13. In addition, heated gas from the heater 84 would flow through line 86 and a distributor 88 located at the top portion of the retort so as to heat the incoming shale. By raising the temperature of the shale in this manner the temperature of the shale will be higher than the condensation temperature of the oil in the off-gas. The rest of the process would remain identical to that of FIG. 1 and would function in the same manner as described in connection with the flow diagram of FIG. 1.

Referring again to FIG. 1, the gas moving through the line 50 from the electrostatic precipitator 42 will contain an amount of steam dependent upon the effect of the various conditions and operations to which the off-gas is exposed during the process, upon the amount of water added back into the system through the water line 16 and upon the amount of water liberated from the shale. It will be appreciated that the amount of steam in the gas exiting the electrostatic precipitator 42 can be continuously monitored and the amount of water passing to the drain can be regulated accordingly so as to adjust the amount of water inserted back into the system, thus maintaining the desired percentage of steam in the recycle gas. It will be understood by those skilled in the art that the means for carrying out the monitoring of the steam content of the gas and the introduction of water into the system are well known and available and need no further explanation.

Figure 3:
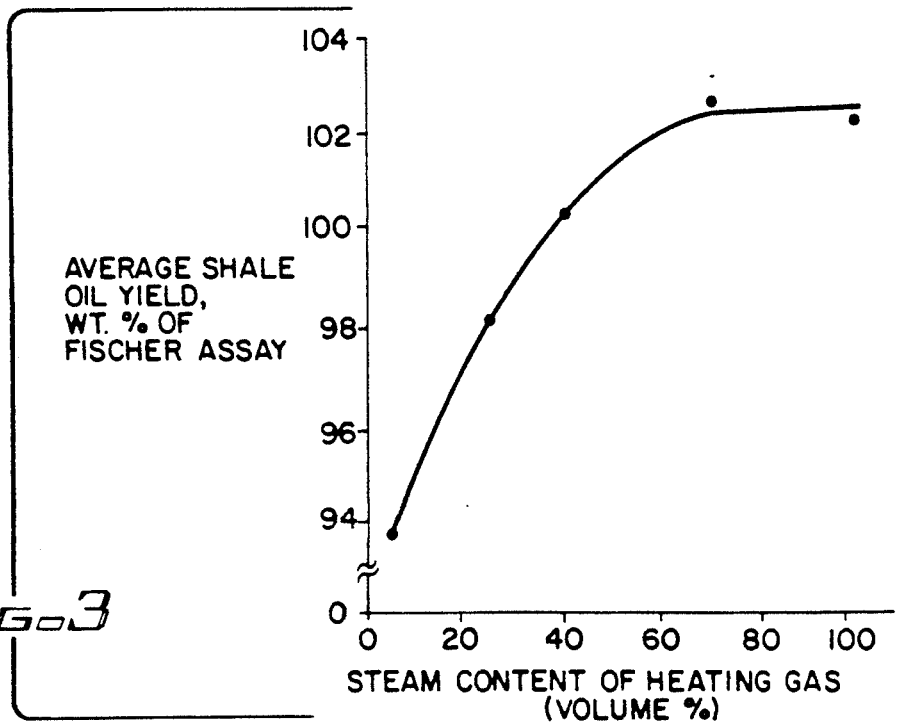
FIG. 3 is a graph plotting the average oil yield against the steam concentration in the heating gas.

The specific amount of steam which should be present in the recycle gas will be determined in part by the economics involved in the operation of the process. The less costly it is to utilize steam, the more steam can be included in the system in order to bring about higher shale oil yields. Within this broad parameter, the present invention permits a great deal of latitude in the amount of steam to be utilized. This is illustrated in the graph of FIG. 3, which is a plot of the average oil yield, in terms of weight percent of the Fischer assay, versus the steam concentration in the heating gas. As shown in the graph, oil shale retorted in a batch retort using 100% steam as the heating medium resulted in average shale oil yields of 102% of the Fischer assay. Oil shale retorted in the same manner using 100% recycle gas resulted in average shale oil yields of only 92% of the Fischer assay. Oil shale retorted using a mixture of 70% steam and 30% recycle gas yielded the same amount of oil as when using 100% steam. Results were only about 2% less when using a mixture of 40% steam and 60% recycle gas. Thus by heating the oil shale with a combination of steam and recycle gas it is possible to drastically reduce the amount of steam requirements while still maintaining the high level of yield previously attainable only through the use of 100% steam as the heating medium. By using even lesser amounts of steam the yield drops, but not nearly as much as would be expected given the differences in yield between the use of 100% steam and 100% recycle gas. When steam is present in amounts within these ranges, the recycle gas will still contain sufficient quantities of carbon dioxide to provide the beneficial effect of inhibiting the decomposition of carbonates in the oil shale.

These results were obtained during batch runs which used oil shale having a $-2+\frac{3}{8}$ inch particle size distribution. In other words, the minimum particle size was not capable of passing through a screen having $\frac{3}{8}$ inch openings whereas the maximum particle size was capable of passing through a screen having openings of 2 inches. Although the yield data was generated using particles of this size, it is possible to use particle distributions with larger or smaller top sizes. The benefit is greater with larger particles, but an advantage was also observed using a $-1+\frac{3}{8}$ inch size distribution. Three inches is about the maximum practical size while $\frac{1}{4}$ inch is about the minimum practical size.

The retorting pressure has not been found to have a significant impact on the process. In fact, within the wide range of 3–25 psi, retorting pressure was found to have only a minor effect on shale oil yield.

It will now be appreciated that the present invention, through simple yet highly effective means, can obtain yields using a mixture of steam and recycle gas as the heating gas in a vertical retorting operation comparable to the yields obtained using 100% steam as the heating gas while operating at the lower pressures of processes using only recycle gas. Moreover, implementation of the invention does not change the basic nature of existing vertical retorting processes, primarily requiring only that changes be made to the system to permit the addition of quench water to the recycle gas.

It will be understood that changes to the process of the invention which do not affect the overall basic function and concept thereof may be made without departing from the spirit and scope of the invention, as defined in the appended claims.

What is claimed is:

1. A process for retorting oil shale in a vertical retort, comprising the steps of:

introducing particles of oil shale into the retort, said particles of oil shale having a minimum size such that the particles are retained on a screen having openings $\frac{1}{4}$ inch in size;

contacting the particles of oil shale with hot gas to heat the particles of oil shale to a state of pyrolysis, thereby producing retort off-gas;

removing the off-gas from the retort;

cooling the off-gas;

removing oil from the cooled off-gas;

separating recycle gas from the off-gas, the recycle gas comprising steam and produced gas, the steam being present in amount, by volume, of at least 50% of the recycle gas so as to increase the yield of said oil; and heating the recycle gas to form said hot gas.

2. The process of claim 1, wherein the recycle gas comprises at least 70%, by volume, of steam.

3. The process of claim 1, wherein the maximum size of the particles of oil shale is such that the particles are capable of passing through a screen having openings 3 inches in size.

4. The process of claim 1, including the step of coalescing the cooled off-gas to form product oil.

5. The process of claim 1, including the step of removing oil from the cooled off-gas by electrostatic precipitation, a portion of the off-gas exiting the electrostatic precipitator comprising the recycle gas.

6. The process of claim 5, wherein a portion of the off-gas exiting the electrostatic precipitator is further cooled and oil is separated therefrom.

7. The process of claim 2, wherein the shale-oil yields when using recycle gas comprising 70% steam and 30% produced gas to heat the oil shale are substantially equivalent to shale-oil yields using 100% steam to heat the oil shale.

8. The process of claim 1, wherein the minimum size of the particles of oil shale is such that the particles are retained on a screen having openings $\frac{3}{8}$ inch in size, and the maximum size is such that the particles are capable of passing through a screen having openings 2 inches in size.

9. The process of claim 1, wherein the recycle gas contains sufficient quantities of carbon dioxide to inhibit the decomposition of carbonates in the oil shale.

10. The process of claim 1 further comprising: maintaining said amount of the steam present in the recycle gas at said at least 50% of the recycle gas so as to increase the yield of said oil.

11. The process of claim 10 wherein the step of maintaining includes introducing water to the retort in amounts sufficient to maintain the steam present in the recycle gas in said amount.

* * * * *